US008870565B2

(12) United States Patent
Knight

(10) Patent No.: US 8,870,565 B2
(45) Date of Patent: Oct. 28, 2014

(54) CANDLE BURNING DEVICE

(76) Inventor: Sal Knight, Cliffside Park, NJ (US)

( * ) Notice: Subject to any disclaimer, the term of this patent is extended or adjusted under 35 U.S.C. 154(b) by 429 days.

(21) Appl. No.: 12/376,628

(22) PCT Filed: Apr. 4, 2008

(86) PCT No.: PCT/US2008/059471
§ 371 (c)(1),
(2), (4) Date: Feb. 6, 2009

(87) PCT Pub. No.: WO2009/123646
PCT Pub. Date: Oct. 8, 2009

(65) Prior Publication Data
US 2010/0178625 A1 Jul. 15, 2010

(51) Int. Cl.
*F23D 3/16* (2006.01)
*F23D 3/18* (2006.01)
*F21V 35/00* (2006.01)

(52) U.S. Cl.
CPC .. *F23D 3/16* (2013.01); *F21V 35/00* (2013.01)
USPC ..... 431/293; 431/288; 431/289; 431/292

(58) Field of Classification Search
USPC ..... 431/288, 289, 292, 293
See application file for complete search history.

(56) References Cited

U.S. PATENT DOCUMENTS

| | | | | |
|---|---|---|---|---|
| 84,103 | A * | 11/1868 | Foote | 431/293 |
| 2,092,471 | A * | 9/1937 | Pomije | 431/293 |
| 2,316,837 | A * | 4/1943 | Candy, Jr. | 431/290 |
| 5,057,005 | A * | 10/1991 | Kwok | 431/253 |
| 5,193,994 | A | 3/1993 | Schirneker | |
| 6,261,088 | B1 | 7/2001 | Butler | |
| 6,264,345 | B1 | 7/2001 | Griffel | |
| 6,695,611 | B2 * | 2/2004 | Lee | 431/293 |
| 6,960,076 | B2 * | 11/2005 | Yu | 431/253 |
| 2008/0020335 | A1 * | 1/2008 | Carlson | 431/35 |
| 2008/0227043 | A1 * | 9/2008 | Kitt | 431/292 |

OTHER PUBLICATIONS

International Search Report and Written Opinion for PCT/US2008/59471.

* cited by examiner

*Primary Examiner* — Kenneth Rinehart
*Assistant Examiner* — William Corboy
(74) *Attorney, Agent, or Firm* — Edwards Wildman Palmer LLP

(57) ABSTRACT

The invention relates to a candle burning device, for example, a candle follower, which comprises a substantially planar body defining an outer rim, a plurality of vent openings, and an approximately centralized depressed recess, the recess defining an aperture for receiving a candle wick; a flange extending downward from the outer rim of the body; and wherein the device is formed of a heat conducting material.

3 Claims, 8 Drawing Sheets

CANDLE BURNING DEVICE

FIELD OF THE INVENTION

The present specification describes a candle burning device, for example, a candle follower. The candle follower is particularly useful for candles having a wider diameter which tend to burn unevenly and/or incompletely. Also described is a removable candle follower that, due to its relatively slim profile, allows for the use of nearly the entire candle, and simultaneously functions as an aesthetically pleasing decoration.

BACKGROUND

The problems associated with dripping candles, complete burning and even burning are well recognized. In particular, the problems associated with burning wider candles, for example, candles having a relatively large diameter (i.e., greater than about an inch (about 2.5 cm)) are readily apparent. For example, these types of candles typically burn unevenly or core burns deeply leaving the walls intact or a combination thereof. The end result is that much of the candle goes unused and the aesthetic appeal of the candle is ruined.

There have been numerous attempts to design candle burning devices, for example, candle followers that sought to provide practical and aesthetically attractive solutions. However, currently available candle followers suffer from a variety of shortcomings. For example, candle holders currently on the market are bulky and/or of relatively heavy construction, and are designed to sit only on the shoulders or outer edges of the candle. These designs can tend to cause the candle to burn unevenly. Other undesirable features include the tendency to fit like a skirt or sleeve over the outside of the candle, which not only conceals the candle but also prevents complete burning. Such followers are also undesirable because they are constructed from expensive glass, solid metals or ceramics. Besides being costly to manufacture and buy, these materials can be become too hot and cause tilting or cocking as the candle burns unevenly. Even less desirable is that many currently available candle followers cause wax pooling along the top and outside of the candle, which inevitably leads to considerable dripping and mess.

Thus, there exists a need in the market for a candle burning device, for example, a candle follower, that is simple, light, reusable, inexpensive to manufacture and sell, and that allows for the substantially even burning of the candle, and at the same time reduces dripping and waste. Moreover, there is a need for such a device that is aesthetically pleasing and which does not conceal a significant portion of the candle. Furthermore, there is a need for a device which provides all these advantages and, in addition, allows the user to burn nearly the entire candle.

SUMMARY

Described herein is a device for the improved burning of a candle. In particular, the invention relates to a candle follower that addresses one or more of the well known shortcomings in the art. In certain aspects the invention encompasses a candle burning device comprising a substantially planar body defining an outer rim, a plurality of vent openings, and an approximately centralized depressed recess, the recess defining an aperture for receiving a candle wick; a flange extending downward from the outer rim of the body portion; and wherein the device is formed of a heat conducting material.

Other aspects and advantages of the present invention will become readily apparent in view of the following Detailed Description and the accompanying Drawings.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

Figure 1:
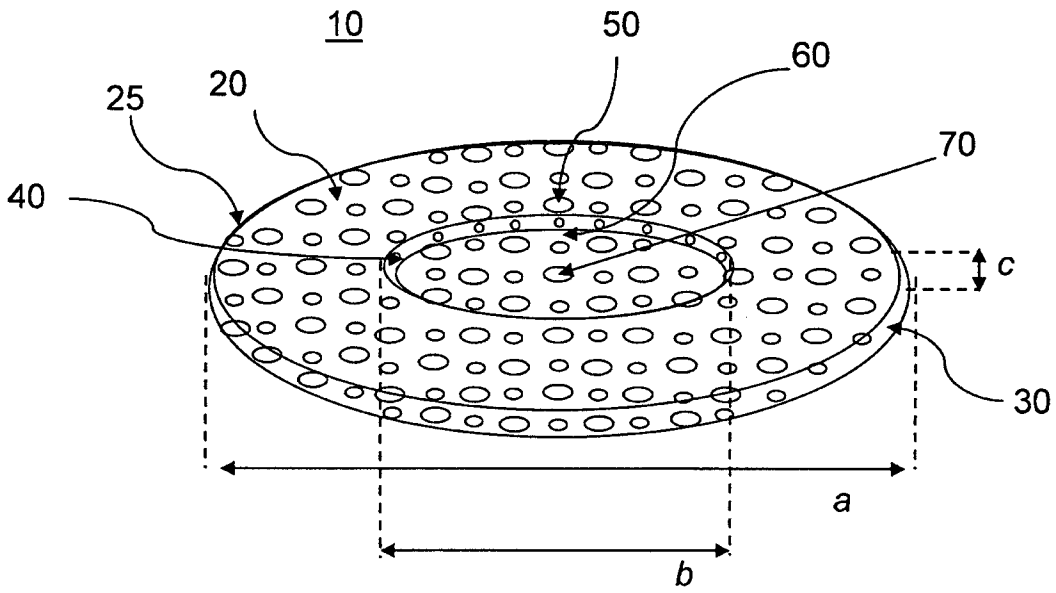
FIG. 1 illustrates a top perspective view of an embodiment of the present invention.

As indicated above, the drawings are provided for exemplary purposes only and are not to be construed as limiting. For example, as would be understood by those of skill in the art, any of the features depicted in the drawings can be combined with any other embodiment or embodiments in any conceivable combination, all of which are contemplated by the inventors and encompassed by the present claims.

DETAILED DESCRIPTION

Described herein is a candle burning device, for example, a candle follower, which addresses many of the well known shortcomings of the art. The candle follower described and claimed herein is particularly useful for candles having a wider diameter, which tend to burn unevenly and/or incompletely. In certain embodiments, the candle follower described herein is formed of a relatively light, heat-conducting material, is simple and economical to manufacture and sell but is also durable and reusable. In additional embodiments, the candle burning device of the invention is relatively slim in its profile, and designed to fit over the apical or top portion or surface of a candle, which allows for the use of nearly the entire candle, and simultaneously functions as an aesthetically pleasing decoration.

As used herein, "relatively slim" means about 3 inches or less in height with reference to the vertical plane (See FIG. 1, "c"). In certain preferred embodiments the device of the invention is equal to or less than about 3, 2, 1, 0.5, or 0.25 inches in height. In a preferred embodiment, the device is from about $1/16^{th}$ of an inch to about 1 inch in height (for conversion and reference purposes, an 1 inch is approximately 2.5 cm).

In certain aspects, the candle burning device comprises a substantially planar body defining an outer rim, a plurality of vent openings, and an approximately centralized depressed recess, the recess defining an aperture for receiving a candle wick; and a flange extending downward from the outer rim of the body portion, wherein the device is formed of a material capable of conducting heat.

It is expressly contemplated that the device can be manufactured from any material capable of conducting heat known to those of skill in the art and the invention is not limited in this regard. Exemplary materials suitable for use in the invention include a metal, for example, tin, aluminum, steel, nickel, pewter, bronze, copper, gold, silver, platinum, titanium, and combinations thereof; alloys; glass; ceramic; and cermet. However, it is also contemplated that the heat conducting material used to manufacture the device be in the form of a sheet or thin layer; the thin construction reducing the overall weight of the device. The particular thickness of which will vary upon a number of considerations such as desired durability, rigidity, cost, and ease of manufacture. These factors are readily determined by those of skill in the art using routine procedures and methods, and does not require undue experimentation.

Exemplary embodiments of the instant invention are described in additional detail below (with reference to FIGS. 1-8), like numbers being used to refer to like features.

FIGS. 1-8 show exemplary candle burning devices 10 of the invention. The device 10 comprises a substantially planar body 20 having a top surface and a bottom surface, defining an outer rim 25. The diameter of the outer rim is depicted by reference arrow, a. It is important to note that the device may be of any suitable size, and therefore, a, can be any value measured using any standard unit or metric, for example, inches or centimeters. It should also be noted that while the embodiments depicted in the Figures are approximately disc-shaped, the invention is not limited thereto. It is expressly contemplated that the device of the invention can be of any suitable geometric configuration known in the art subject only to the caveat that the particular shape of the device of the invention substantially match the cross-sectional geometry of the candle on which it is to be placed. However, most candles have a substantially circular cross-section, and therefore, in certain exemplary embodiments, the planar body 20 of the device is approximately disc-shaped.

Figure 7:
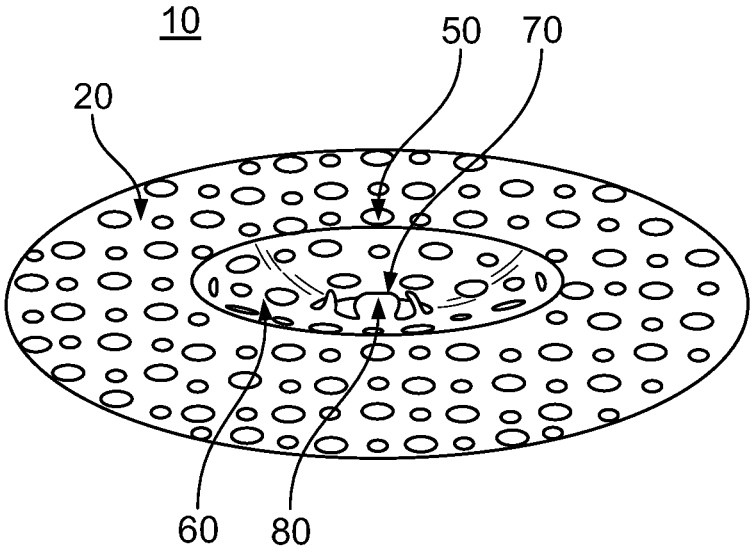
FIG. 7 illustrates a top perspective view of another embodiment of the present invention.
Figure 8:
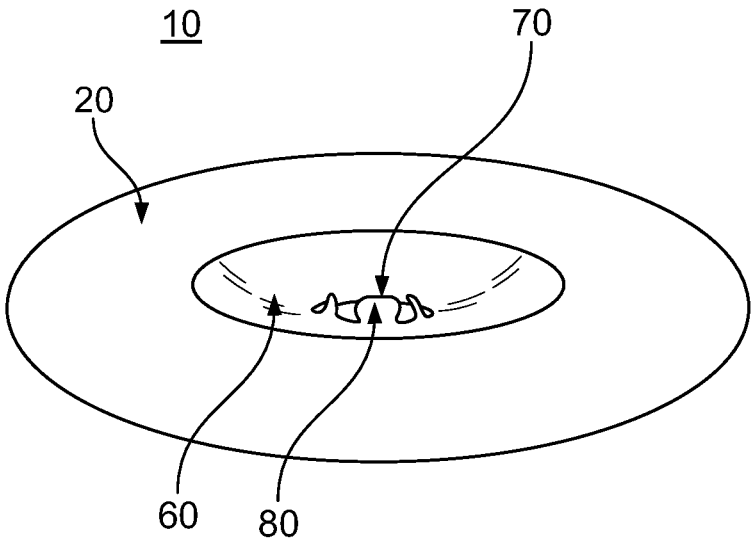
FIG. 8 illustrates a top perspective view of another embodiment of the present invention.

The device 10 further comprises an approximately centralized depressed recess 60 with respect to the top surface. With reference to the exemplary embodiment in FIG. 1, the recess defines a diameter indicated by reference arrow, "b." Similar to "a" the recess can be of any size or shape. However, it is recognized that is the usual situation a flame will burn the wax in a circular pattern radiating outward in all directions from the wick, and therefore, in a preferred embodiment the recess is circular in shape will be approximately the same size as the average size of the pool of molten wax formed by the particular candle. The determination of the average size of the pool of molten wax for any particular candle size is readily and easily determined by those of skill in the art and does not require undue experimentation. In addition, the recess 60 of the device 10 depicted in the Figures also shows a flange 40 extending axially downward, substantially perpendicularly from the inner rim of the planar body 20. However, the invention is not limited thereto. For example, it is also contemplated that the device have a recess 60 formed as a gradual or curved depression, for example, a bowl shape, as depicted in FIGS. 7 and 8, versus the substantially vertical wall or flange 40 as depicted in FIGS. 1-6.

The recess 60 of the device 10 in the Figures further comprises and aperture 70 for receiving the candle wick. In certain embodiments, the aperture for receiving a candle wick is disposed in approximately the center of the recess. However, the device of the invention is not so limited. For example, it is expressly contemplated that the candle burning device of the invention can be modified to fit a candle having a plurality of candle wicks, disposed in any configuration. Therefore, the candle burning device of the invention may similarly have a plurality of apertures for receiving a plurality of candle wicks; the apertures being arranged in any suitable configuration.

Without being bound by any particular theory it is believed that the recess is important for the functioning of the device because it allows air to feed the flame, helps to regulate the temperature of the device, serves as a seat on the molten wax allowing the device to remain balanced, and/or promotes the flow of wax from the periphery to the molten center.

Figure 4:
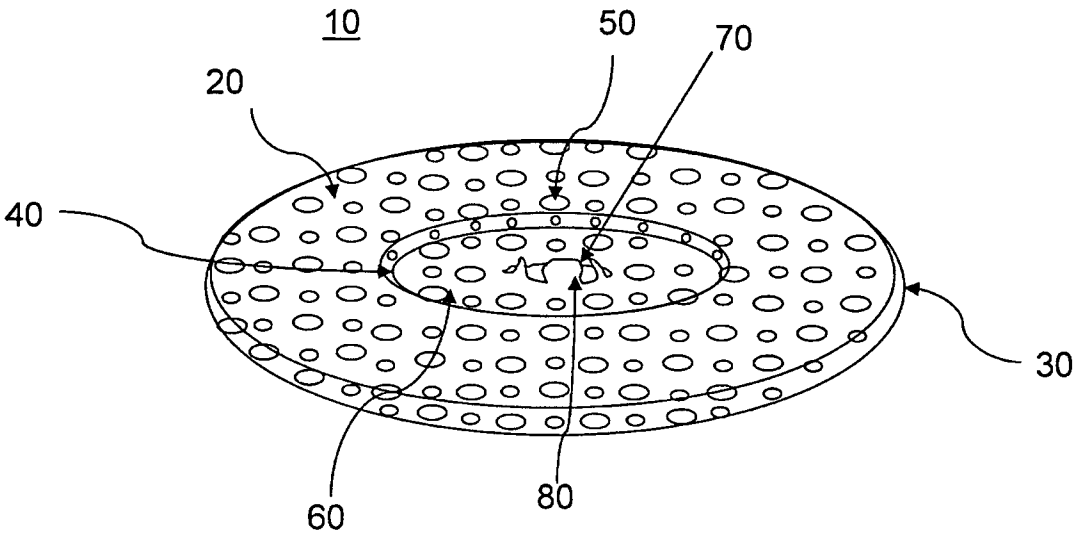
FIG. 4 illustrates a top perspective view of another embodiment of the present invention. This embodiment further comprises at least one upwardly biased fin portion disposed proximally to the wick aperture to substantially shield the candle flame from being extinguished by air currents. In addition, the fin portions allow for more efficient heat capture and conductance.
Figure 5:
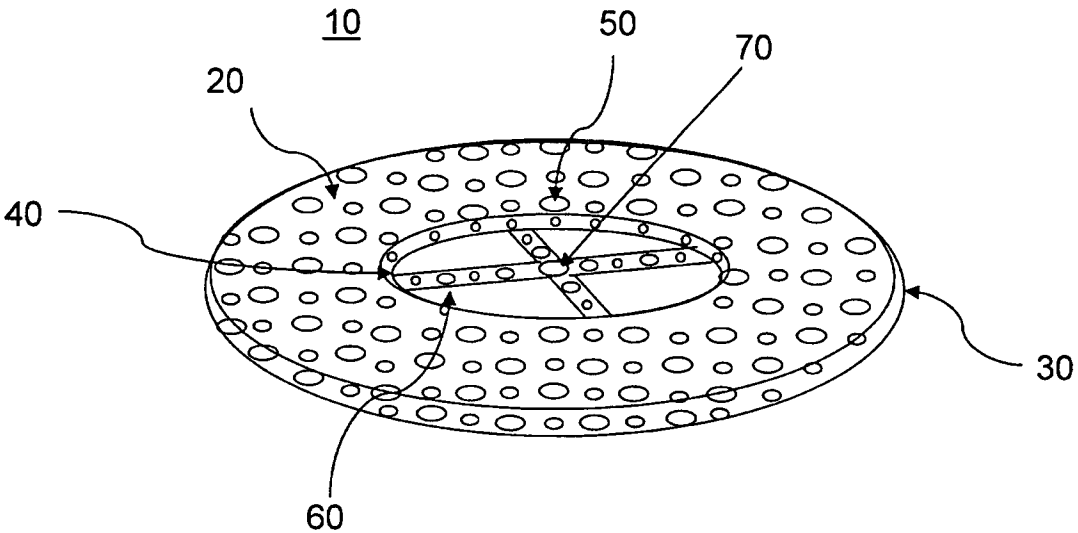
FIG. 5 illustrates a top perspective view of another embodiment of the present invention.
Figure 6:
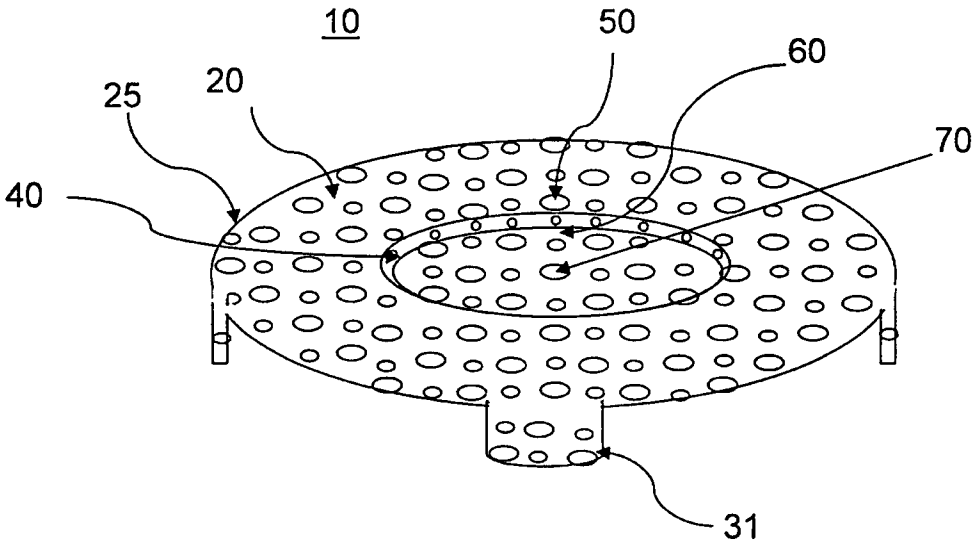
FIG. 6 illustrates a top perspective view of another embodiment of the present invention.

In any of the embodiments described herein, the device may also comprise one or more fins 80 (See FIG. 4). The fins 80 may be of any suitable size or shape and provide the additional advantages of protecting the flame from strong air currents as well as providing for more efficient heat conduction.

In certain embodiments, the candle burning device 10 further comprises a flange 30 extending downward from the outer rim 25 of the substantially planar body 20. In the preferred working mode, the flange 30 forms an overhang that is on or near the side of the candle body. The flange 30 helps balance the device, promotes even burning of the candle, and keeps the device is position atop the burning candle. Also, in certain embodiments, the length of the flange 30 is approximately equal to the height of the device 10, as depicted by reference arrow, c, described above (See FIG. 1). However, the invention is not so limited. For example, additional embodiments are contemplated in which the flange 30 has a length which is larger or smaller than the height, c, of the device. In addition, the flange 30 can completely surround the outer rim 25 as in FIGS. 1, 4-5 or the flange 30 can be discontinuous, for example, such as the tabs 31 of FIG. 6.

In addition, the candle burning device 10 depicted in FIGS. 1-7 comprises a plurality of vents 50. The vents may be of any desirable size, shape or number, and combinations thereof. In addition, in certain embodiments the plurality of vents 50 are located only on the planar body 20. In additional embodiments, the vents are disposed on at least one of the planar body, the recess portion, the flange or a combination thereof.

Figure 2:
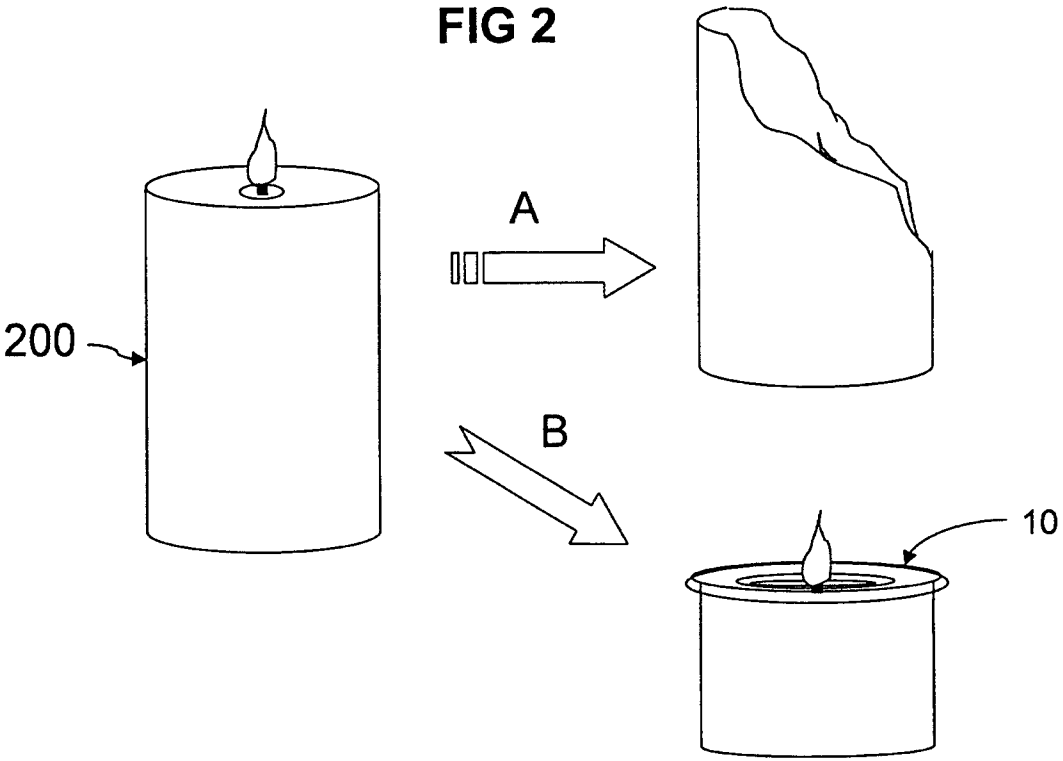
FIG. 2 illustrates the functioning of a device encompassed by the claims. (A) illustrates the common problem of uneven/incomplete candle burning observed with candles of larger diameter or width (e.g., greater than approximately one inch (about 2.5 cm)); (B) illustrates the results observed with burning an identical candle with the device of the invention. The candle follower of the invention allows for approximately even and complete burning of the candle.
Figure 3:
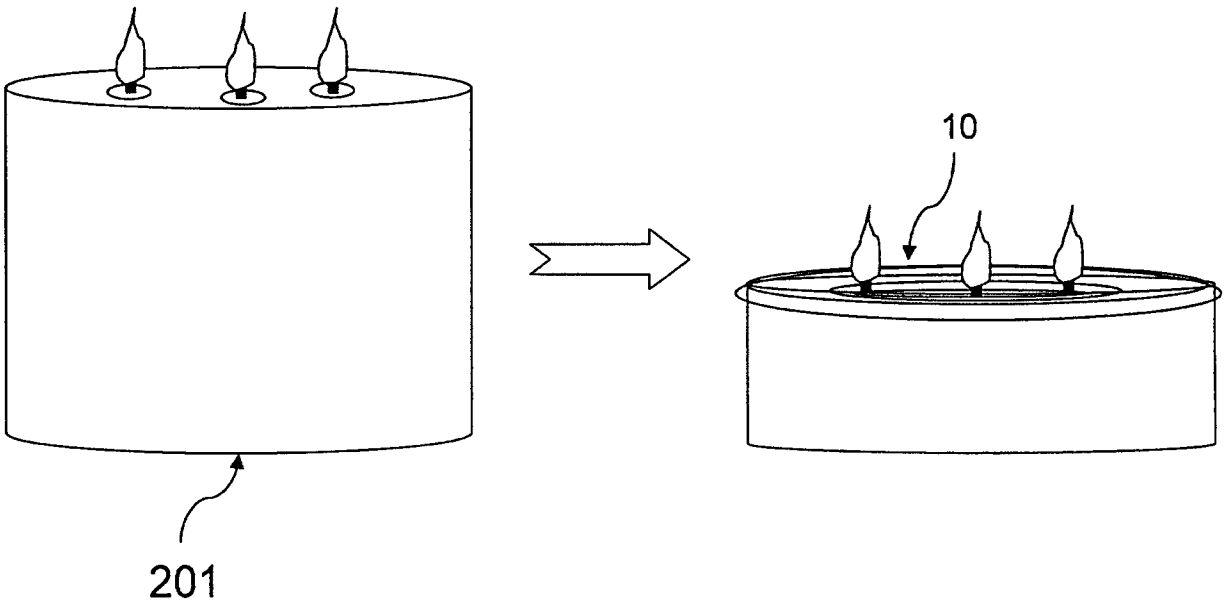
FIG. 3 illustrates the functioning of another device encompassed by the claims. In this embodiment the candle follower of the invention comprises multiple apertures to accommodate candles having more than one wick.

FIGS. 2 and 3 illustrate the operation and advantages of the candle burning device encompassed by the claims. As described above, candles having a relatively wide diameter tend to burn unevenly and incompletely (FIG. 2, A). This is a problem well known in the art and is recognized as reducing the aesthetic appearance of the candle as well as resulting in a significant amount unused or wasted candle. This, of course, means that consumers do not usually get their money's worth in terms of enjoyment time, out of the candle. The present invention addresses this problem because it provides a simple, durable, relatively light weight, and inexpensive candle burning device. As depicted in FIG. 2, B; and FIG. 3, the present invention sits atop the candle, and covers substantially the entire apical surface of the candle. In normal operating mode, the device of the invention allows the candle to burn and promotes the formation of a substantially uniform pool of molten wax in the center. Because the device is formed of a thin, heat conducting material, heat is captured from the candle flame and warms approximately the entire surface of the device. The device descends by gravity as the candle burns. While not being bound by any particular theory, the inventors believe that the vents help regulate the temperature of the device surfaces and allow for the formation of a semi-solid wax seal between the candle and the device, which promotes the controlled flow of wax from the outer portions of the candle into the molten center where it is burned. It is believed that overheating of the follower increases the melting rate of the wax, which tends to result in tilting of candle follower and uneven burning of the candle.

Again, while not being limited by any particular theory, the inventor hypothesizes that because of the light construction and slim profile, the device of the invention is able to rest gently on the molten and semi-solid wax and remain balanced. As such, the device allows for the even burning of the candle and resists the tendency to tilt or cock as it burns (See, FIG. 2, B; and FIG. 3). In addition, in contrast to currently available followers the device of the invention rests upon the apical or top portion of the candle, and therefore, the device of the invention does not conceal the candle or diminish its aesthetic appearance. Moreover, because the device sits upon the top surface of the candle it allows the user to burn nearly the entire candle. Another advantage of the present invention is that the design promotes the flow of wax into the molten center versus prior devices that sit mainly on the outside of the candle which tends to promote wax dripping down the sides of the candle body.

As may be recognized by those of ordinary skill in the pertinent art based on the teachings herein, numerous changes and modifications may be made to the above-described and other embodiments of the present invention without departing from the scope of the invention as defined in the appended claims. For example, the candle follower may take on any of numerous different configurations, sizes, colors, or may be formed of any of numerous different heat-conducting materials that are currently known or that later become known; any of a variety of the disclosed components may be eliminated, or additional components or features may be added. For example, the number, shape, and location of vents on the device can be changed in an almost innumerable number of ways which are contemplated by the inventors and encompassed by the claims. Accordingly, this detailed description of the currently-preferred embodiments is to be taken in an illustrative, as opposed to a limiting sense.

What is claimed is:

1. A candle burning device comprising:

a substantially planar body extending along a horizontal axis having a top and bottom surface, the body defining an outer rim, a plurality of vent openings, an approximately centralized bowl-shaped depressed recess with respect to the top surface that also comprises a plurality of vent openings, an aperture for receiving a wick from a candle, and a plurality of upwardly biased fins near the wick aperture;

wherein the device is formed of a unitary piece of heat conducting material to evenly conduct heat from the device directly to a top surface of the candle;

wherein the aperture for receiving the wick is disposed at approximately the center of centralized bowl-shaped depressed recess; and wherein the bottom surface of the body contacts the top or apical surface of the candle.

2. The device of claim 1, further comprising a flange extending downward from the outer rim of the substantially planar body.

3. The device of claim 1, wherein the heat conducting material is a material selected from the group consisting of a metal, an alloy, a glass, a ceramic, a cermet, and combinations thereof.

* * * * *